United States Patent [19]

Voorhees

[11] Patent Number: 4,744,180

[45] Date of Patent: May 17, 1988

[54] SANDING WHEEL

[76] Inventor: Theodore Voorhees, 331 Greenacres Dr., Anderson, Calif. 96007

[21] Appl. No.: 899,069

[22] Filed: Aug. 20, 1986

[51] Int. Cl.[4] ..... B24D 17/00

[52] U.S. Cl. ..... 51/358; 51/364; 51/365; 51/381; 51/382

[58] Field of Search ..... 51/358, 364–372, 51/381, 387, 382, 395, 397, 398

[56] References Cited

U.S. PATENT DOCUMENTS

| | | | |
|---|---|---|---|
| 2,049,874 | 8/1936 | Sherk . | |
| 2,084,513 | 6/1937 | Tone . | |
| 2,555,946 | 6/1951 | Trussell | 51/370 |
| 3,540,162 | 11/1970 | Blackmer . | |
| 4,237,852 | 9/1980 | Wiener . | |
| 4,484,560 | 11/1984 | Tanigawa . | |
| 4,535,574 | 8/1985 | Dettelbach . | |
| 4,571,893 | 2/1986 | Braasch | 51/397 |

*Primary Examiner*—Frederick R. Schmidt
*Assistant Examiner*—Maurina Rachuba
*Attorney, Agent, or Firm*—Leonard D. Schappert

[57] ABSTRACT

A sanding wheel is provided having easily removable and replaceable contoured abrasive strips enabling use of the sanding wheel to sand workpieces of different contours accurately without replacement of the complete sanding wheel.

5 Claims, 2 Drawing Sheets

SANDING WHEEL

BACKGROUND OF THE INVENTION

1. Field of the Invention

The present invention is directed generally toward apparatus designed to increase efficiency during sanding operations, and more specifically toward devices known as sanding wheels.

2. Description of the Prior Art

Previous art in the area of abrasive and sanding devices has included slotted abrasive wheels, dressing tools for gear grinding machines, diamond-coated segmented saw blades and other diamond-coated abrasive tools, including tools formed to a particular contour to assist in grinding an article to the desired contour. More specifically, existing art has included sanding belts which, though relatively easy to replace, are not generally available with contoured surfaces, and tend to have a limited life as a result of the buildup of abrasive dust thereon. Abrasive wheels and discs have also been utilized, but these develop the same problems inherent in any sanding operation, primarily that the buildup of abrasive dust limits the life of such devices. While discs with outer contoured surfaces have been utilized, and while some of these discs have consisted of formed wheels including slots or relieved areas to allow for removal of abrasive dust, such discs are constructed as solid wheels having their outer surfaces contoured, and are not easily repairable.

Further, as each of the units discussed above is used, the contour of the sander changes as a result of the abrasive dust loading the surface, necessitating repair or replacement of the whole wheel or belt. Flapped abrasive sanders have been utilized, but they are unable to accurately follow contours for any period of time. The present invention addresses and solves all of the problems just presented by providing a sanding wheel with a contoured surface and including means for the removal of abrasive dust. It also provides for changing the contour of the surface of the sanding wheel quickly and without modification of the wheel itself. None of the prior art of which applicant is aware has taught a sanding wheel including the unique structure, features and advantages taught herein.

SUMMARY OF THE INVENTION

The present invention includes a head which is substantially cylindrically shaped, with a mounting hole positioned substantially in the center to allow mounting on an armature or shaft. The head has two circumferential flange rings mounted one on each side thereof. The flange rings are so shaped that, while they are attached to the top and bottom surfaces of the head, they extend around the edge, creating lips which create a slot between the lips and the circumference of the cylinder. The invention further includes a contoured abrasive strip constructed of plastic or other flexible material having abrasive materials on the surface thereof. The contoured strip slips into the slots formed between the lips of the circumferential flange rings and the outer surface of the head and is held in position therein during sanding. Because of the structure utilized, the contoured strip may be vacuum-formed to match any given contour desired, and once abrasive material is attached thereto, may be utilized for sanding contoured surfaces. The areas of contoured strip to which abrasive material is attached are raised and separated with open areas therebetween so that a particular contoured strip will include multiple raised sections, each section having substantially the same contour as the others.

One of the objects of the present invention is to provide a sanding wheel which is inexpensive to construct and versatile in use.

Another object of the present invention is to provide a sanding wheel which is easily removed from a machine upon which it is being used.

A further object of the present invention is to provide a sanding wheel which utilizes removable and replaceable contoured abrasive strips so that the sanding wheel may be used for sanding workpieces of different shapes.

A further object of the present invention is to provide a sanding wheel which includes easily removable and replaceable abrasive material so that the sanding wheel need not be removed from the machine upon which it is mounted in order to change the abrasive surface thereof.

Another object of the present invention is to provide a sanding wheel which is of relatively simple construction so that, should any damage occur thereto, it is easily repairable.

The foregoing objects, as well as other objects and benefits of the present invention, are made more apparent by the descriptions and claims which follow.

DESCRIPTION OF THE PREFERRED EMBODIMENT

The present invention consists of a sanding wheel 21 which utilizes a removable and replaceable contoured abrasive strip 31 positioned thereon to facilitate use with workpieces requiring different contours.

Figure 1:
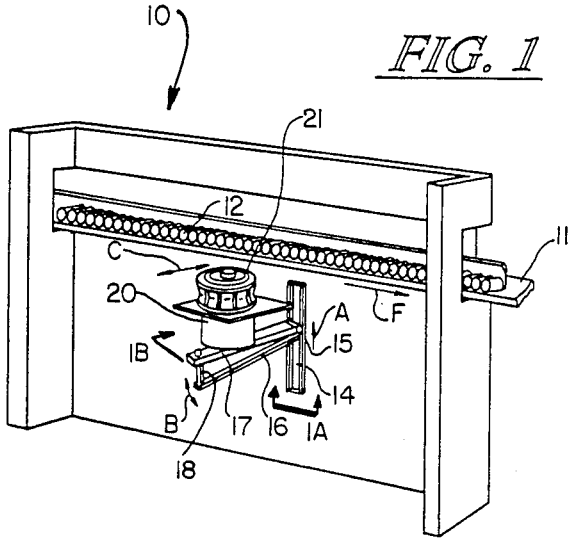
FIG. 1 of the drawings is a perspective view showing the sanding wheel in position on a machine with which it is being used.

FIG. 1 is a perspective view showing the sanding wheel 21 in position on a processing machine 10. The processing machine 10 includes a set of rollers 12 designed to hold a workpiece 11 in proper orientation as it moves along the path indicated by arrow F. The sanding wheel 21 is mounted on motor 20 so that sanding wheel 21 turns when motor 20 is operated. During operation, a movable support 17 upon which motor 20 is positioned pivots on hinge 15 and is adjusted by adjustment means 18, which in this embodiment consists of a screw or other adjustment means. With proper use of adjustment means 18, the angular position of sanding wheel 21 with respect to workpiece 11 may be adjusted as indicated by arrow B to precisely orient sanding wheel 21 to workpiece 11 as desired. Sanding wheel 21 is raised and lowered by adjustment of slidable support 16, to which movable support 17 is attached, up and down on track 14 as indicated by arrow A. Lateral movement of sanding wheel 21 is achieved by means of a slide arrangement which allows motor 20 to slide laterally along movable support 17 as indicated by arrow C.

Figure 1A:
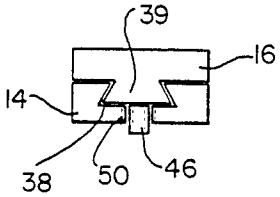
FIG. 1A is a cross-sectional view taken along line 1A of FIG. 1 and showing the structure of the track utilized in raising and lowering the sanding wheel into position.
Figure 1B:
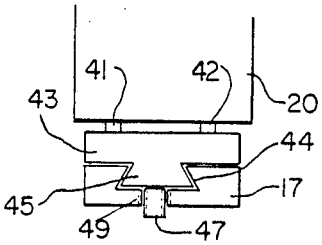
FIG. 1B is a cross-sectional view taken along line 1B of FIG. 1 and showing the track utilized in laterally positioning the sanding wheel.

FIGS. 1A and 1B of the drawings show the structure of the tracks utilized in raising and lowering and laterally moving sanding wheel 21. FIG. 1A, which is taken along line 1A of FIG. 1, shows the structure utilized in raising and lowering sanding wheel 21. Specifically, track 14 has a slot 38 provided therein and a slidable support 16 which includes an extension 39 of substantially the same shape as slot 38 so that slidable support 16 is held in substantially rigid orientation with respect to track 14. When slidable support 16 is set to the desired vertical position, a locking device such as screw 46 extending through threaded hole 50 in track 14 as shown and butting against extension 39 of slidable support 16 is tightened to hold slidable support 16 in position.

FIG. 1B of the drawings shows the track arrangement utilized to allow lateral movement of sanding wheel 21 in the direction indicated by arrow C. Movable support 17 includes a slot 44 positioned therein defining a track very similar to that shown in FIG. 1A. The motor 20 is mounted to a sliding block 43 by means of fastening means 41 and 42. Fastening means 41 and 42 consist of screws in this embodiment, but any other acceptable and reliable fastening means could be employed. Sliding block 43 includes an extension 45 the shape of which is substantially the same as the shape of slot 44 in movable support 17. As a result, motor 20 is held in a substantially rigid orientation with respect to movable support 17. A locking device such as screw 47 extending through threaded hole 49 in movable support 17 and butting against extension 45 of sliding block 43 is provided to lock the lateral position of sanding wheel 21 once the desired position is achieved.

Figure 2:
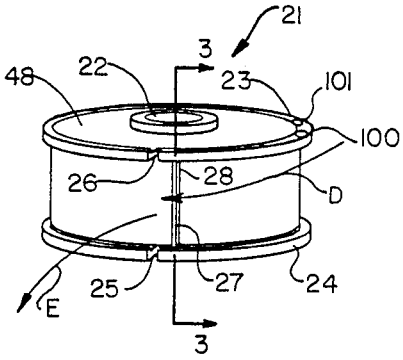
FIG. 2 is a perspective view showing the general structure of the sanding wheel.

FIG. 2 of the drawings is a perspective view of sanding wheel 21. The basic structure of sanding wheel 21 consists of a substantially cylindrically shaped body 48 having a top surface, a bottom surface and a cylindrical surface. A hole 22 is provided substantially concentrically positioned in body 48 to facilitate attachment to an armature or shaft. Two substantially circumferential rings 23 and 24 are attached to body 48 at the top and bottom surfaces by fasteners such as screws 100 and 101 as shown. The circumferential rings 23 and 24 each have a small section removed to form slots 25 and 26 and shown. A slot 28 and plate 27 are provided in body 48. The operation of slot 28 and plate 27 is disclosed more fully in FIG. 3 of the drawings. During preparation of sanding wheel 21 for operation, a contoured abrasive strip 31 as shown in FIG. 4 is slid through slots 25 and 26 into a slot formed between circumferential rings 23 and 24 and the cylindrical surface of body 48 along the path shown by arrow D. As the contoured abrasive strip 31 is pushed around the cylindrical surface of body 48 to approach plate 27, it butts against plate 27 and is held in position by plate 27 during sanding operations. The operator can remove contoured abrasive strip 31 by depressing plate 27 and removing as indicated by arrow E.

Figure 3:
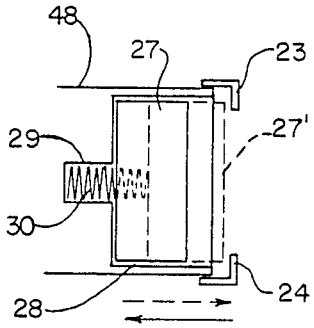
FIG. 3 is a cross-sectional view taken along lines 3—3 of FIG. 2 and showing the spring-loaded plate utilized in restraining the contoured strip from moving during operation of the sanding wheel.
Figure 4:
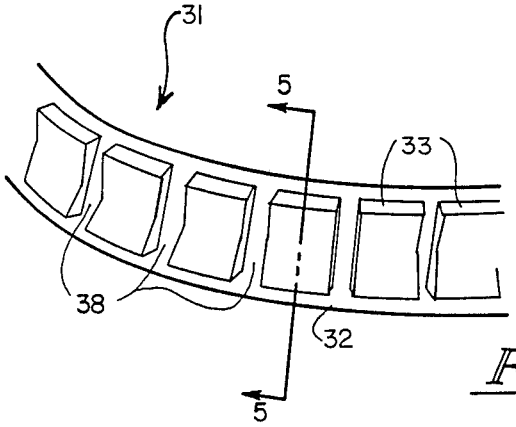
FIG. 4 is a perspective view of the contoured abrasive strip utilized with the sanding wheel.

FIG. 3 is a cross-sectional view of the sanding wheel 21 taken along lines 3—3 of FIG. 2. A slot 28 is cut into the outer surface of body 48 to provide for the positioning of plate 27 therein. Further, a hole 29 is provided within which a coil or other type of spring 30 is positioned so that force is exerted therefrom upon plate 27 to keep plate 27 in position to stop movement of contoured abrasive strip 31 with respect to body 48 during operation. Plate 27 and spring 30 are shown with plate 27 pushed toward the center of body 48 as far as possible. With plate 27 released, it assumes the position shown as 27', but is prevented from moving farther by circumferential rings 23 and 24. Circumferential rings 23 and 24 are formed so that they provide a lip extending circumferentially about body 48, thereby providing the slot into which contoured abrasive strip 31 is slid.

FIG. 4 of the drawings shows the structure of the contored abrasive strip 31 in greater detail. Contoured abrasive strip 31 consists of a flat piece 32 with raised sections 33 extending outward therefrom and leaving slots 38 between raised sections 33. Slots 38 between raised sections 33 are important because, without them, sawdust, chips and other abrasive dust will build up during sanding of a workpiece. Slots 38 prevent loading of the surface of contoured abrasive strip 31 by creating air turbulence and providing an avenue of escape for the abrasive dust so that sanding wheel 21 is self-cleaning, with less wear as a result. When wear does occur, contoured abrasive strip 31 is simply removed from sanding wheel 21 and replaced with a new strip.

Figure 5:
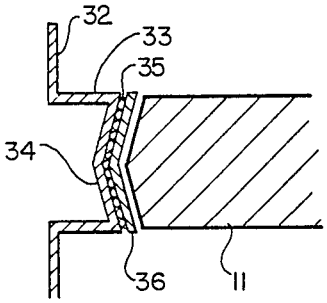
FIG. 5 is a cross-sectional view of the contoured abrasive strip taken along lines 5—5 of FIG. 4.

FIG. 5 is a cross-sectional view of contoured abrasive strip 31 taken along lines 5—5 of FIG. 4. Contoured abrasive strip 31 is constructed of a single sheet of plastic or other formable material, together with abrasive material such as sandpaper. When the sheet of plastic from which contoured abrasive strip 31 is constructed is formed, it results in a base 32 with raised sections 33 as shown. The top surface 34 may be shaped to any desired contour to match the contour of a piece of molding or other material to be sanded. Abrasive material 36 is cut to match the size and shape of the top surface area 34 of raised sections 33 and is attached thereto by adhesive 35. The resulting contoured surface of abrasive material 36 matches the contoured surface of workpiece 11.

Figure 6:
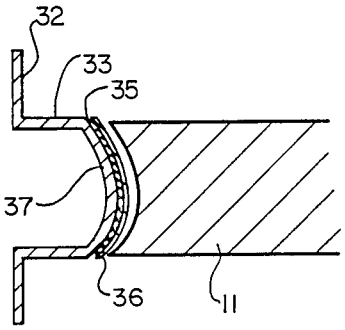
FIG. 6 is a cross-sectional view of the contoured abrasive strip of FIG. 4 taken along lines 5—5, but with an alternative contoured portion.

FIG. 6 is a cross-sectional view of contoured abrasive strip 31 of FIG. 4 taken along lines 5—5 of FIG. 4 and showing an alternative contoured surface which may be utilized. The top surface of raised section 33 is designated 37, but all other numbers remain as in FIG. 5. The contoured abrasive strip 31 may be vacuum-formed and, whether the contour of the surface of abrasive material 36 is concave, as shown in FIG. 5, or convex, as shown in FIG. 6, the contoured abrasive strip 31 works equally well. The key to the operation of contoured abrasive strip 31 and its usefulness is that contoured abrasive strip 31 may be produced inexpensively with extreme accuracy, and may be removed and replaced as desired, depending upon the needs of an operator of sanding wheel 21. Because plastic and/or other formable and somewhat flexible material is utilized in constructing the contoured abrasive strip 31, a certain degree of flexibility is inherent in the strip; this results in less likelihood of damage to the sanding wheel 21, contoured abrasive strip 31 and the workpiece 11 being sanded.

While the foregoing description of the invention has shown a preferred embodiment using specific terms, such description is presented for illustrative purposes only. It is applicant's intention that changes and variations may be made without departure from the spirit or scope of the following claims, and this disclosure is not intended to limit applicant's protection in any way.

I claim:

1. A sanding wheel, comprising:

a substantially cylindrically shaped body having a top surface, a bottom surface and a cylindrical surface bounded by said top and bottom surfaces;

a contoured abrasive strip extending around and substantially covering said cylindrical surface of said body, and quick installation and removal means consisting substantially of first and second circumferential rings attached to said substantially cylindrically shaped body, said first circumferential rings being positioned so that a first slot is formed between said first circumferential ring and said cylindrical surface proximate to said top surface, and said second circumferential ring being positioned so that a second slot is formed between said second circumferential ring and said cylindrical surface proximate to said bottom surface, and wherein said contoured abrasive strip slides into said first and second slots and is held in position against said cylindrical surface by said first and second circumferential rings.

2. The invention of claim 1, including stop means for restraining said contoured abrasive strip from slipping with respect to said cylindrical surface during operation of said sanding wheel.

3. A sanding wheel, comprising:

a substantially cylindrically shaped body having a top surface, a bottom surface and a cylindrical surface bounded by said top and bottom surfaces;

a contoured abrasive strip, constructed substantially of a sheet of flexible molded material having raised sections molded to a desired contour, extending around and substantially covering said cylindrical surface of said body, and quick installation and removal means consisting substantially of first and second circumferential rings attached to said substantially cylindrically shaped body, said first circumferential rings being positioned so that a first slot is formed between said first circumferential ring and said cylindrical surface proximate to said top surface, and said second circumferential ring being positioned so that a second slot is formed between said second circumfernetial ring and said cylindrical surface proximate to said bottom surface, and wherein said contoured abrasive strip slides into said first and second slots and is held in position against said cylindrical surface by said first and second circumferential rings.

4. A sanding wheel, comprising:

a substantially cylindrically shaped body having a top surface, a bottom surface and a cylindrical surface bounded by said top and bottom surfaces;

a contoured abrasive strip consisting substantially of a unitary strip of molded material having multiple raised sections separated by unraised areas, resulting in slots between said multiple raised sections, having abrasive material positioned on the surface of said raised sections, said contoured abrasive strip extending around and substantially covering said cylindrical surface of said substantially cylindrical shaped body;

stop means for substantially restraining said contoured abrasive strip from moving with respect to said cylindrical surface of said substantially cylindrically shaped body during operation of said sanding wheel, and quick installation and removal means, including at least two retaining means for restraining said contoured abrasive strip from moving laterally on said cylindrical surface, whereby said contoured abrasive strip is easily installed and removed.

5. The invention of claim 4, wherein said contoured abrasive strip is constructed of a sheet of flexible molded material having raised sections molded so that their surfaces match a desired contour, thereby matching the contour of a workpiece to be sanded.

* * * * *